US006308844B1

(12) United States Patent
Okada et al.

(10) Patent No.: US 6,308,844 B1
(45) Date of Patent: Oct. 30, 2001

(54) METHOD FOR HANDLING AN EQUIPMENT INSIDE A BUILDING BY A CRANE INSTALLED OUTSIDE

(75) Inventors: Hisako Okada; Hiroshi Hasegawa; Jun Miura; Ryohei Miyahara; Kouichi Ushiroda, all of Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/461,727

(22) Filed: Dec. 16, 1999

(30) Foreign Application Priority Data

Dec. 16, 1998 (JP) ..... 10-357226

(51) Int. Cl.[7] ..... B66C 13/46
(52) U.S. Cl. ..... 212/270; 212/276
(58) Field of Search ..... 212/273, 285, 212/298, 270, 271, 276

(56) References Cited

U.S. PATENT DOCUMENTS 2,254,083 * 8/1941 Nickles et al. ..... 212/285
4,280,627 * 7/1981 Becker ..... 212/198
5,907,111 * 5/1999 Josten et al. ..... 73/866.5

FOREIGN PATENT DOCUMENTS

449329 * 10/1991 (EP) ..... 212/273
401285594 * 11/1989 (JP) ..... 212/285
7-010470 1/1995 (JP) .
10-142374 5/1998 (JP) .

* cited by examiner

*Primary Examiner*—Thomas J. Brahan
(74) *Attorney, Agent, or Firm*—Antonelli, Terry, Stout & Kraus, LLP

(57) ABSTRACT

A method for handling an equipment inside a building by a crane installed outside; the method being employed when leading the wire hanging from the boom of a crane installed outside of a building (nuclear reactor containment vessel, into the building through an opening provided on the building, and lifting up or down an equipment inside said building by said wire. The said method includes a process for measuring by a three-dimensional measuring device which is positioned apart from the crane the shift of the boom caused by transfer of dead load of the equipment to the wire, in the course of transferring dead weight of the equipment between the wire and a structure inside the building, and correcting the position of the boom, by moving said boom up or down, back to a direction opposite to the shift so as to lift up the equipment vertically.

4 Claims, 5 Drawing Sheets

METHOD FOR HANDLING AN EQUIPMENT INSIDE A BUILDING BY A CRANE INSTALLED OUTSIDE

BACKGROUND OF THE INVENTION

The present invention relates to a method for handling an equipment inside a building by a crane installed outside.

Of late years, a large crane is more frequently used in a construction project and maintenance project of, for example, power station or chemical plant as a means for shortening the project schedule and making up for a lack of skilled labors and field labors. Particularly in a maintenance project, it is frequently needed to replace a component part of a product installed there.

In carrying out a replacement work, advanced operation technique to the order of millimeter is required of a large crane to avoid possible trouble such as interference with existing facilities. Such replacement work is disclosed in Japanese Laid-Open Patent Publication No. Hei 8-435777 (1996).

Generally, in removing a product out of a place, there occurs a phenomenon that, as the load of the product transfers from the installation surface of the product to the large crane, the boom of the large crane moves downward and the boom top shifts from the vertical line above the product. This means that a tension is applied from the wire to the product installed on the ground in the forward direction of the boom.

As the product is set free horizontally at the moment when being lifted off from the installation surface (as soon as the product is fully lifted up), it is swung forward by the afore-mentioned tension.

In carrying a product into a place and installing it, on the other hand, as the load of the product is transferred from the large crane to the contact surface (installation position), the boom of the large crane moves backward from the vertical line above the product and accordingly a horizontal load is applied from the wire to the product in the backward direction of the boom.

Conventionally, installation using a large crane was mostly applied to a new construction project. Because a product which required lifting operation in the course of the construction was lifted from an outdoor temporary storage yard, cares were taken so that interference with adjacent objects would be avoided even if the product swung upon the lift-off.

Beside, when carrying a product into a place, it was sufficient to rely only upon the crane operator's skill to achieve required accuracy of the carriage because the product was to be placed down on a foundation structure which was constructed in consideration of some impact.

In a maintenance project, on the other hand, if no measures are taken when removing a product out of a limited place in a building where existing facilities stand in the neighborhood of the product, it is possible that the product swings as soon as it is lifted up and may collide against the existing facilities.

Besides, when a replacement product is carried into a place and the products is adjusted to its installation position or matched to the existing mating piping, controlling the moving range of the replacement product is necessary for fine adjustment and how the afore-mentioned horizontal load from the wire can be eliminated is an important point.

As a means to solve these problems, one of the methods could be to shift the boom in the opposite direction prior to lifting up a product. According to Japanese Laid-Open Patent Publication No. Sho 64-38397 (1989), by inputting data acquired though a load test in an arithmetic unit prior to actual lifting operation, it is said to be possible to quantitatively predict at time of actual lift-off how much the boom needs to be shifted beforehand in the opposite direction for a given load. A similar method is also known according to Japanese Laid-Open Patent Publication No. Hei 1-167199 (1989).

According to Japanese Laid-Open Patent Publication No. Hei 9-79826 (1997), it is said to be possible to detect a change in the crane working radius caused by bowed deformation of the crane jib due to load, using a tachymeter employed for land survey and multiple reflecting mirrors mounted on the jib.

According to Japanese Laid-Open Patent Publication No. Hei 1-256497 (1989), by detecting a change in the boom length and derricking angle caused by deflection of the boom during actual lifting operation and correcting the derricking motion of the boom automatically, it is said to be possible to prevent swinging of a product upon lift-off. Similar methods are also known according to Japanese Laid-Open Patent Publication No. Hei 1-256496 (1989), and Laid-Open Utility Model Publication Nos. Hei 5-46882 (1993) and Hei 63-4989 (1988).

SUMMARY OF THE INVENTION

With regard to the method described in Japanese Laid-Open Patent Publication No. Sho 64-38397 (1989) and others, where the shift of the boom in the opposite direction is obtained automatically at time of the lifting operation by registering the load data obtained from a prior test, it is difficult to completely eliminate the swing during the lifting operation because external obstructive factors (e.g. weather condition such as wind) during the actual lifting operation cannot be taken into account.

With regard to the method described in Japanese Laid-Open Patent Publication No. Hei 9-79826 (1997), where a change in the crane jib radius is detected using a tachymeter and reflecting mirrors, method for relating the obtained change to the crane operation is not clearly described.

Moreover, because the measuring point is established on each crane jib, resulting in more frequent measurement and higher data volume, it is difficult to feed back the data to the crane operation in a short period of time.

With regard to the method described in Japanese Laid-Open Patent Publication No. Hei 1-256497 (1989), where a change in the boom length and derricking angle is detected, it is not easy to take measurement because specific detector is required for each crane. Moreover, method for preventing collision against existing structures in the neighborhood caused by the swing of the product upon lift-off (the product which has been fully lifted up from the ground) is not clearly described.

Therefore, an object of the present invention is to provide accurate control in handling an equipment inside a building in vertical direction, using a crane installed outside.

Fundamental requirement of the means for achieving the object of the present invention is a method for handling an equipment inside a building by a crane installed outside; said method being employed when leading a wire hanging from the boom of a crane installed outside into said building through an opening provided on said building, and lifting up or down an equipment inside said building by said wire; said method including a process for moving said boom up or down toward a correct position for lifting said equipment vertically in the course of transferring dead weight of said equipment between said wire and a structure inside said building; said method allowing to accurately handle an equipment inside a building in vertical direction even if the inside of the building cannot be observed from the operator's cage of the crane.

DETAILED DESCRIPTION OF THE PREFERRED EMBODIMENTS

Figure 1:
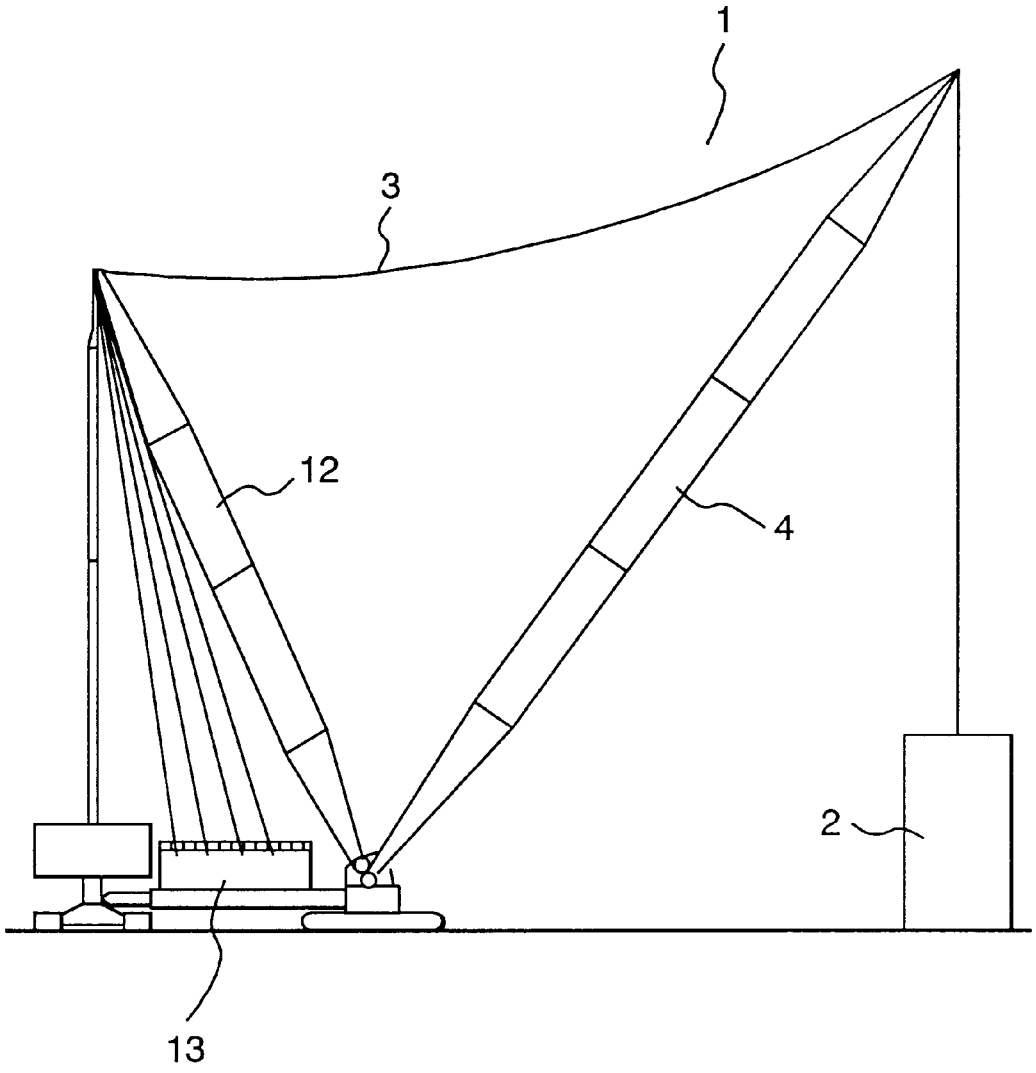
FIG. 1 is a side view of a large crane used in the embodiments of the present invention, showing a condition before lifting up a product.

Embodiments of the present invention are explained hereunder, using drawing figures.

Nuclear reactor containment vessel 10 is the building to which the present invention applies, and the roof of the building is a dome. Nuclear reactor containment vessel shielding walls 14 are installed around the nuclear reactor containment vessel 10.

An opening 11 is provided in a part of the dome roof of the nuclear reactor containment vessel 10 by a size big enough to vertically pass a steam generator of about 350 tons in weight (hereinafter called the product 2), which is a component device of a nuclear power station, into or out of the building prior to the replacement work of product 2.

In the replacement work, the product 2 is lifted up or down by a large crawler crane (hereinafter called the large crane) shown in FIG. 1 and carried into or, on the contrary, removed out of the nuclear reactor containment vessel 10 through the opening 11.

The wire 3 of the large crane 1 for lifting up the product 2 is stretched from the machine room 13 of the large crane 1 up to the top of the boom 4, via the top of the mast 12, and then suspended downward and connected with a product by means of a lifting beam such as a hook. Other wires are also stretched from the machine room 13 to the top of the mast 12 via the top of the mast 12 so as to raise or lower the boom 4.

Each wire can be wound onto or unwound out of the drum by a hoisting gear inside the machine room 13, that is, the hoisting operation can be carried out in a manner that the product 2 is lifted up by winding the wire 3 and lifted down by unwinding, and the derricking operation can be carried out in a manner that the boom 4 is raised by winding the afore-mentioned other wires and lowered by unwinding. As a result of the derricking operation, the derricking angle of the boom 4 changes and the horizontal travel range of the wire suspended from the boom 4 onto an object varies.

Each of the above operations can be operated by an operator from the operator's cage provided at a portion of the large crane 1 near the machine room 13. In the operator's cage, a display of a load meter detecting the lifting load applied to the wire 3 is installed at a position easy for the operator to monitor.

Because the large crane 1 as above is given a capability of lifting a heavy object, and accordingly the wire 3 has a large diameter and the number of windings onto a drum is large, the weight of the wire 3 itself is very heavy and therefore the wire 3 causes sagging by its own weight between the top of the mast 12 and the top of the boom 4.

FIG. 2 shows a side view of the large crane lifting up the product 2, from the start of lifting until the moment of lift-off.

Figure 2A:
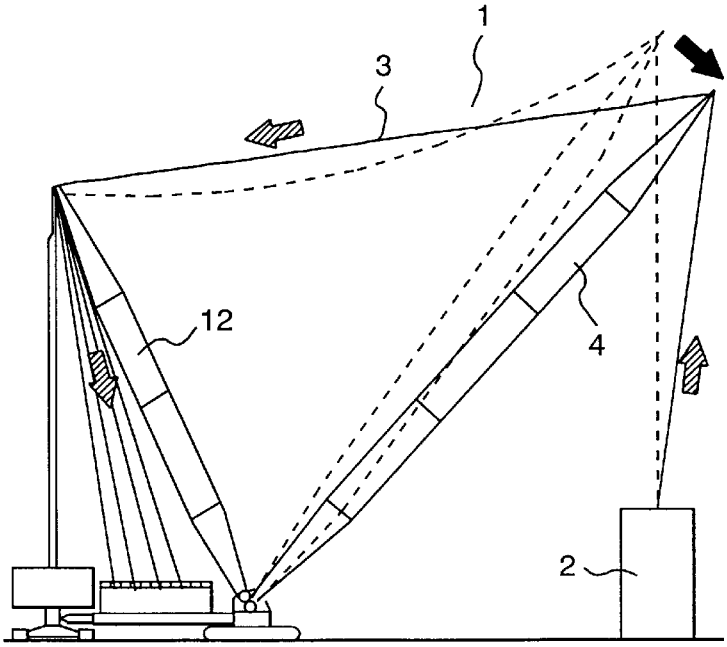
FIG. 2*a* is a side view of a large crane in FIG. 1, showing a condition just after starting to lift up a product.
Figure 2B:
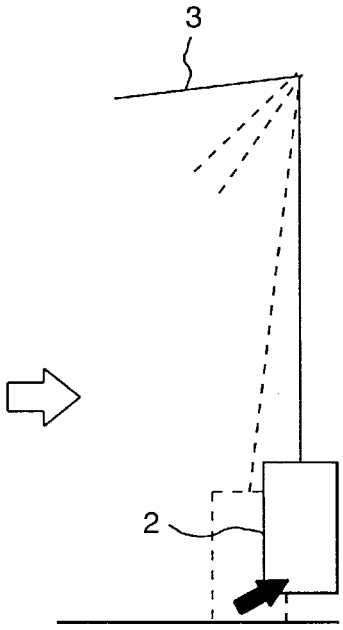
FIG. 2*b* shows swing of a product at the moment just after being lifted off.

As the load applied to the afore-mentioned large crane 1 in FIG. 1 changes from no-load state (as shown by a broken line in FIG. 2*a*, 2*b*) to loaded state as shown by a solid line in FIG. 2*a*, that is, as the load applied to the contact surface of the product 2 is transferred to the large crane 1 via the wire 3 of the large crane 1, the wire 3 becomes tense and the boom 4 is moved forward as if lowered. As the weight of the product 2 begins to transfer, as a load, from the contact surface to the wire 3 as above, the boom 4 begins to shift from a state shown by a broken line to that by a solid line in FIG. 2*a*.

According as the above shift, the top of the boom 4 of the large crane 1 shifts from the vertical line above the lifting point of the product 2 and the wire 3 suspended from the boom 4 becomes tilt. When this happens, a tension in the forward direction of the boom 4 is applied, via the wire 4, onto the product 2 which has not yet been fully lifted up. If the product 2 is further lifted up under this condition, the product 2 is set free horizontally, from a state shown by a broken line to that by a solid line in FIG. 2*b*, upon the lift-off and therefore swung forward, i.e., toward the arrow direction in FIG. 2*b* by the above-mentioned tension.

Because of this, if no measures are taken when removing the product 2 out of a limited place in a building where existing facilities stand in the neighborhood, it is possible that the product 2 swings as soon as it is lifted up and may collide against the existing facilities. It may be a possible means for preventing the above collision to return the top of the boom 4 back to the vertical line above the product 2 to be lifted beforehand during the afore-mentioned derricking operation, but it is difficult to predict necessary return quantitatively. Because the job site where the product 2 is handled by the large crane 1 is inside a nuclear reactor containment vessel 10 which cannot be observed from the operator's cage and also because other structures stand in the neighborhood of the product 2 and accordingly an accident by collision is apt to be caused there, improved accuracy in handling a product is further demanded.

Now, the embodiments of the present invention utilizing a three-dimensional measuring device are explained hereunder.

The following describes the embodiments where a light-wave type survey instrument is employed as the three-dimensional measuring device. It is a method where a light wave or other wave transmitted from the light-wave type survey instrument is reflected by an optical measurement reflecting mirrors mounted at a target point and the reflected light is received by the light-wave type survey instrument, thus measuring the position of the target as three-dimensional coordinates.

Figure 3:
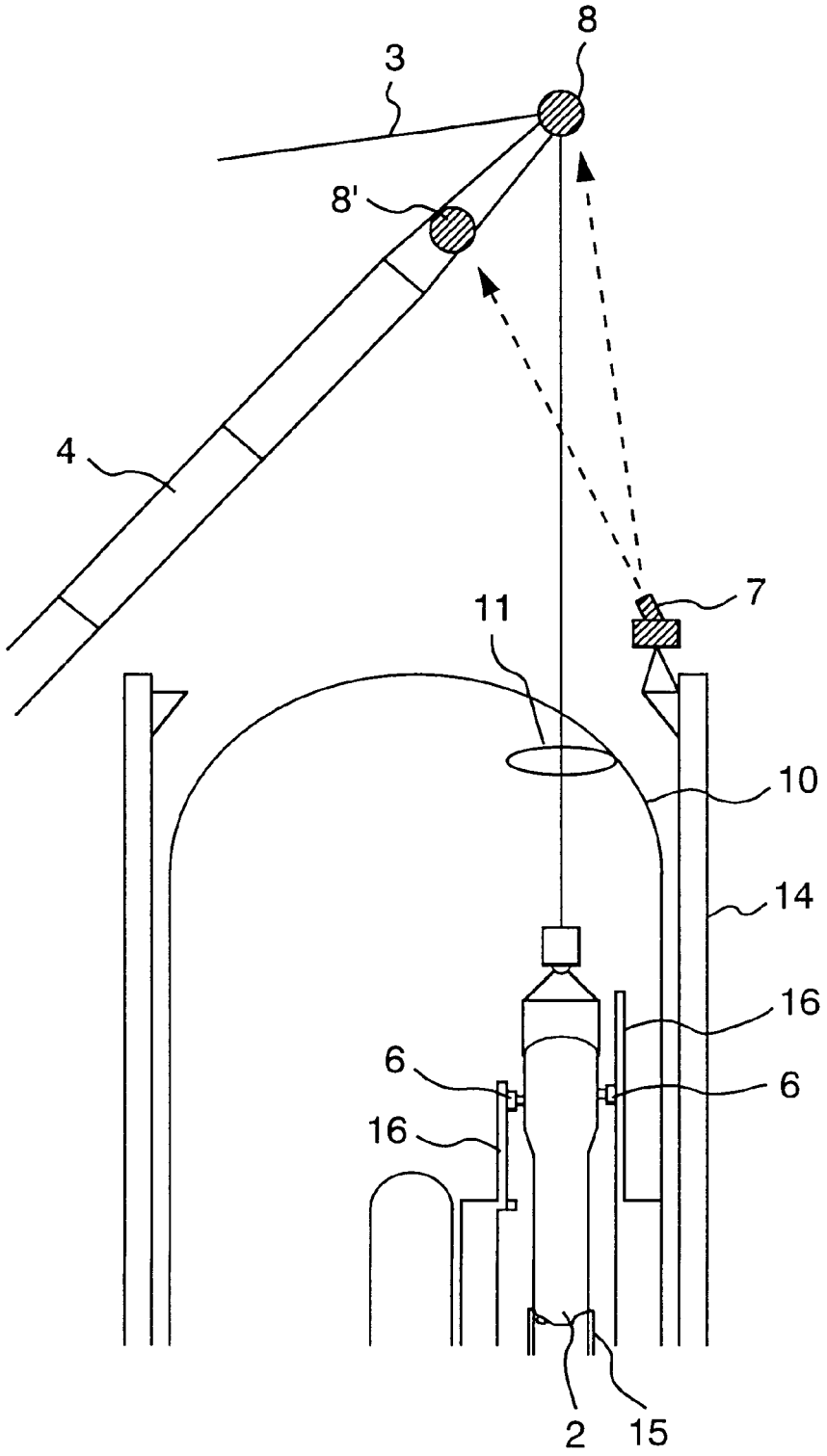
FIG. 3 explains how a product is removed, carried or installed by a large crane using three-dimensional measuring device according to the embodiments of the present invention.

FIG. 3 shows a condition in removing a product out of a place by a large crane, using a three-dimensional measuring device.

The coordinates of the optical measurement reflecting mirrors 8 and 8' mounted on the top of the boom 4 of the large crane 1 are measured by the three-dimensional measuring device 7 which has been set to a range for measuring the positions on the top of the boom 4. The direction of the boom 4 can be represented by a vector connecting the coordinates of the optical measurement reflecting mirror 8 to those of the reflecting mirror 8' (direction of the vector is from the coordinates of the reflecting mirror 8 toward those of the reflecting mirror 8'). Then, of the vector connecting the coordinates of the optical measurement reflecting mirror 8 to those of the reflecting mirror 8', the coordinate system is converted so that a component parallel to the ground surface is set to the X axis, a component vertical to the ground surface is set to the Z axis and a direction perpendicular to the X axis on the ground surface is set to the Y axis; and the point 8 is set to the reference (zero) coordinate. This conversion allows for the crane operator to regard the back and forth direction as the X axis, right and left direction as the Y axis and up and down direction as the Z axis so that the crane operator can easily understand the movement of the reference point. As a result of the above, movement of the boom 4 of the large crane 1 can be monitored three-dimensionally on the coordinates.

Figure 4:
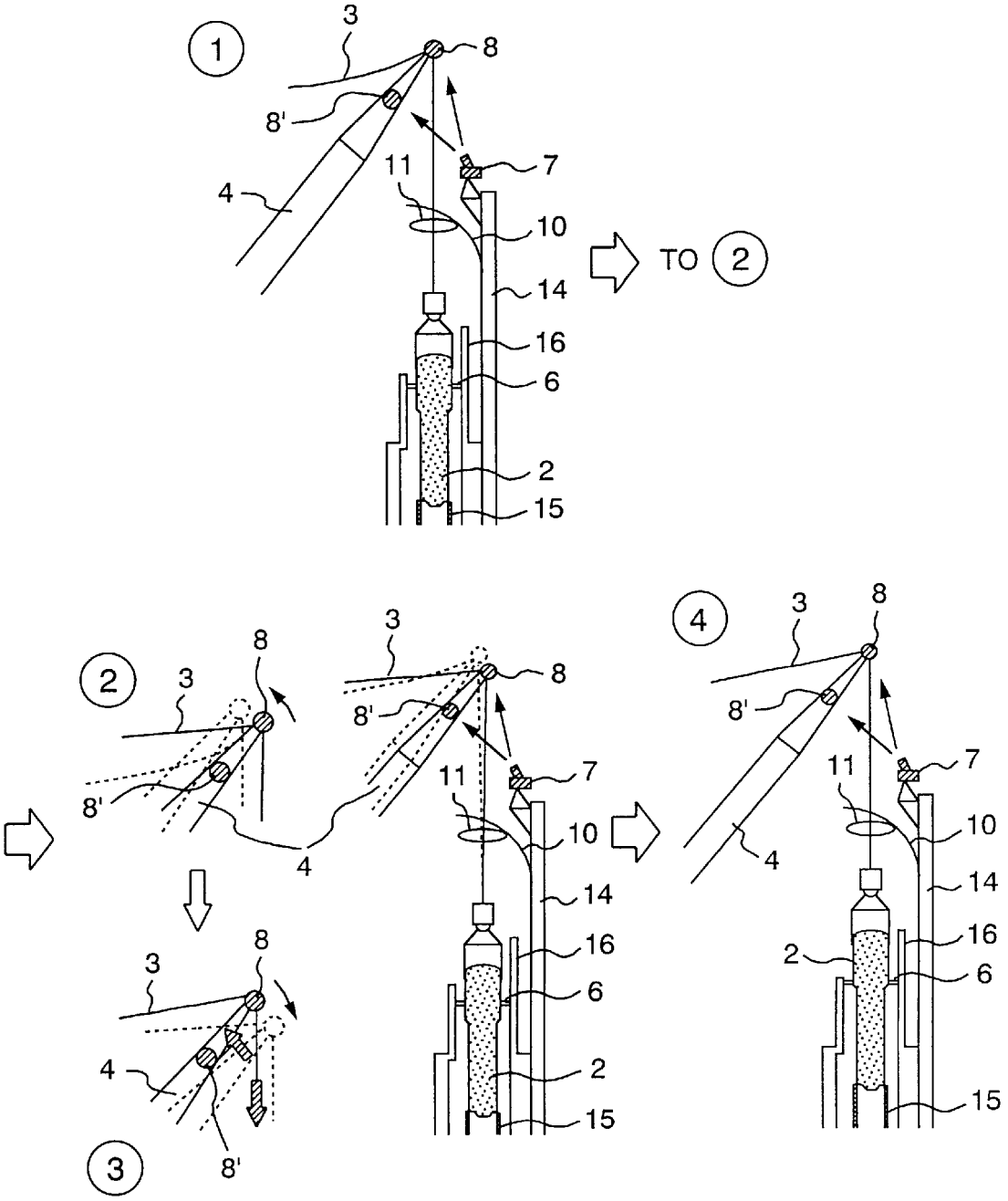
FIG. 4 explains steps of procedure ①②③④ for monitoring the shift of the boom by three-dimensional measurement until a product is fully lifted up (lift-off) by a crane and procedure for feeding back the measure data and correcting the position by operating the crane according to the embodiments of the present invention.

FIG. 4 shows the steps of procedure for monitoring the movement of the boom by the three-dimensional measuring device 7 and also the condition for feeding back the measured data and correcting the position at each step by operating the large crane 1, from the start until the moment when the product 2 is actually lifted off by the large crane 1. It is noted that, in the beginning, the product 2 is supported by the steam generator support structure 15 inside the nuclear reactor containment vessel.

Around the product 2, there stand the structures of the radioactive ray shielding walls 16. As a means for controlling the position of the product 2, guide rollers 6 are mounted on the radioactive ray shielding walls 16, being laid out as if surrounding the product 2, where rollers of the guide rollers 6 are faced to the product 2 and can rotate freely on the vertical plane.

In FIG. 4-①, the coordinates of the optical measurement reflecting mirrors 8 and 8' mounted on the top of the boom 4 of the large crane 1 are measured by the three-dimensional measuring device 7 installed at a higher level on the external shielding wall 14 located apart from the large crane 1, prior to the lifting operation (before load of the product 2 is applied to the large crane 1, that is, while no load is applied to the large crane 1 but full load remains on the contact surface of the product 2), then the data are converted by the above-mentioned method and the point 8 is set to the reference (zero) coordinate.

In FIG. 4-②, in order to quantify the shift of the top of the boom 4 caused after the load remaining on the contact surface of the product 2 begins to transfer to the large crane 1, the position of the optical measurement reflecting mirror 8 mounted on the top of the boom 4 is measured by the three-dimensional measuring device 7 and the coordinates of the top of the boom 4 after the shift are measured.

Next, in FIG. 4-③, in order to feed back the shifted coordinates of the top of the boom 4 by operating the large crane 1, movement in each X, Y and Z direction is informed to the crane operator. The movement can be informed in a manner, for example, that the surveyor who took measurement using the three-dimensional measuring device informs the crane operator by means of a radio-transceiver. The crane operator then repeats raising the boom 4 of the large crane 1 and unwinding the wire 3 so as to return the shifted coordinates of the top of the boom 4 of the large crane 1 back to the reference coordinate under no-load state and to correct the shift between the top of the boom 4 of the large crane 1 and the lifting point of the product 2 along the vertical line.

A series of operations for measuring the above-mentioned shift at the top of the boom 4 by the three-dimensional measuring device 7 as described in FIG. 4-② and feeding back the shift of the boom 4 by operating the large crane 1 as described in FIG. 4-③ will be repeated each time when it is observed in monitoring the display of the load meter of the large crane 1 that 10% of full load of the product (this percentage should be determined beforehand through experiences in load tests, etc.) has transferred to the large crane.

In FIG. 4-④, the coordinates of the optical measurement reflecting mirror 8 mounted on the top of the boom 4 of the large crane 1 are measured just before the product 2 is finally lifted up, and then full load of the product 2 is transferred to the large crane 1 and the product 2 is lifted off the contact surface after confirming that there remains no shift between the top of the boom 4 of the large crane 1 and the lifting point of the product 2 along the vertical line. Because of this, it is possible to lift up a heavy load of the product 2 without swinging.

Figure 5:
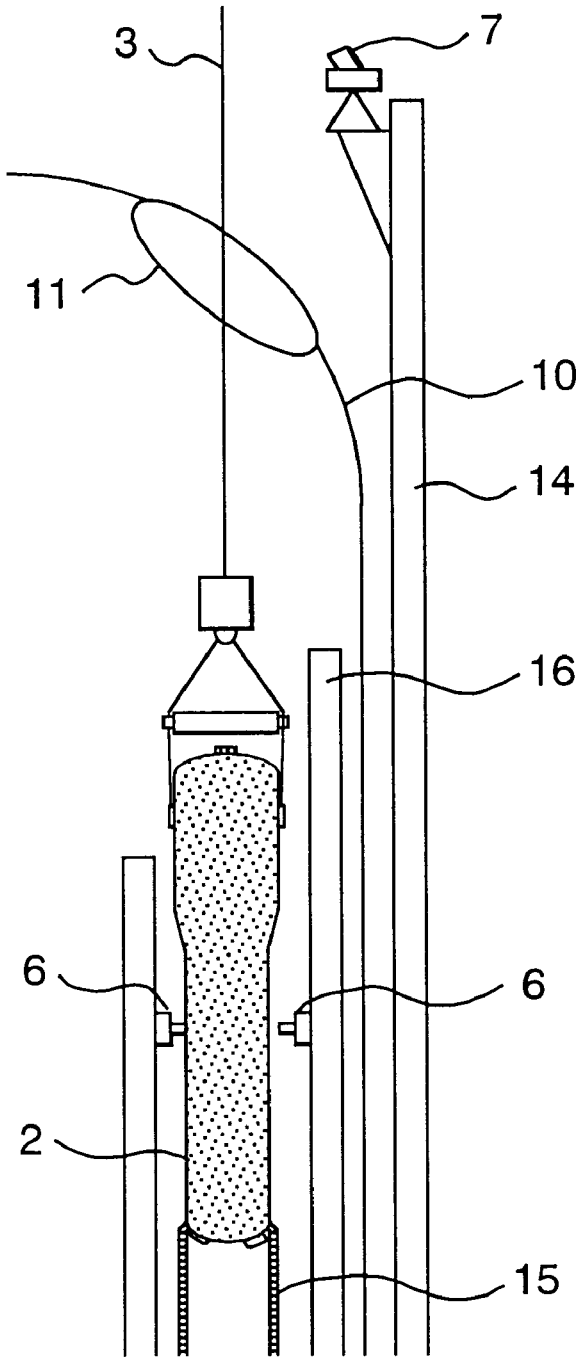
FIG. 5 shows typical installation of guide rollers according to the embodiment of the present invention.

The product 2 after the lift-off is to be moved upward by the lifting operation of the large crane 1 within a limited space, where the radioactive ray insulation walls 16, one of the existing facilities stand close. It is very dangerous if the product 2 begins to swing by an external factor such as wind during this operation, resulting in a collision against the radioactive ray shielding walls 16 and causing damage to the radioactive ray shielding walls 16. FIG. 5 shows a condition where the guide rollers 6 are mounted on the radioactive ray shielding walls 16 so as to control the position of the product 2 within a limited range and prevent swinging, thus assisting smooth guidance of the product 2. This method allows the product 2 after the lift-off, which is being supported in an unstable condition simply by the wire 3 of the large crane 1, to be controlled and guided by the guide rollers 6 mounted on the radioactive ray shielding walls 16 so as not to move excessively in the horizontal direction and be remove out of the place safely without any swing.

On the other hand, when moving and installing the product 2 into a place by the large crane 1, the coordinates of the optical measurement reflecting mirrors 8 and 8' mounted on the top of the boom 4 of the large crane 1 are measured by the three-dimensional measuring device 7 before the product is placed off (before the load of the product 2 is fully transferred from the large crane 1 onto the installation position of the product 2) and converted by the afore-mentioned method, and then the point 8 is set to the reference (zero) coordinate.

In order to quantify the shift of the top of the boom 4 caused after the load applied to the large crane 1 decreases gradually and until the full load of the product 2 is applied to the installation position of the product 2, the position of the optical measurement reflecting mirror 8 mounted on the top of the boom 4 is measured by the three-dimensional measuring device 7 and the shifted coordinates of the top of the boom 4 are measured.

In order to feed back the shifted coordinates of the top of the boom 4 by operating the large crane 1, movement in each X, Y and Z direction is informed to the crane operator. The crane operator repeats lowering the boom 4 of the large crane 1 and winding the wire 3 so as to return the shifted coordinates of the top of the boom 4 of the large crane 1 back to the reference (zero) coordinate and to correct the shift between the top of the boom 4 of the large crane 1 and the lifting point of the product 2 along the vertical line. A series of operations for measuring the above-mentioned shift at the top of the boom 4 by the three-dimensional measuring device 7 and feeding back the shift of the boom 4 by operating the large crane 1 will be repeated each time when 10% of full load of the product (this percentage should be determined beforehand through experiences in load tests, etc.) has transferred to the installation position of the product 2.

The coordinates of the optical measurement reflecting mirror 8 mounted on the top of the boom 4 of the large crane 1 are measured just before the product 2 is finally placed off, and then full load of the product 2 is transferred to the installation position of the product 2 and entire load applied to the large crane becomes nil after confirming that there remains no shift between the top of the boom 4 of the large crane 1 and the lifting point of the product 2 along the vertical line. Because of this, it is possible to eliminate a horizontal load which would otherwise be applied to the product 2 from the wire 3 of the large crane 1 and control an impact load to be caused by placing off the product 2.

In moving and installing the product 2 into a place by the large crane 1, the product 2 before reaching the installation surface is being supported in an unstable condition simply by the wire 3 of the large crane 1, and it is very dangerous if the product 2 begins to swing by an external factor such as wind, resulting in a collision against the radioactive ray shielding walls 16. In the same manner as for removing a product out of a place, the guide rollers 6 mounted on the radioactive ray shielding walls 16 makes it possible to prevent swinging of the product 2, guide the product 2 smoothly, and eliminate possible contact of the product 2 on the sides. In addition, even if the horizontal load to be applied by the wire 3 of the large crane 1 cannot be eliminated completely by the above method when the product 2 is placed off and the full load is transferred to the installation position, the guide rollers 6 mounted on the radioactive ray shielding walls 16 help prevent a lateral shift of the product 2 from the installation position.

As described above, the product 2 is handled up or down passing through the radioactive ray shielding walls 16. In order to avoid possible contact between a portion projected from the product 2 toward outside, such as a nozzle, and a portion projected from inside the radioactive ray shielding walls 16 toward the product 2 in the vertical direction while the product is passed through the walls 16, the following means is provided.

That is, the product 2 is equipped with a wire which is wound horizontally around the product 2 right-handed and one end of which is connected to the product 2 (hereinafter called the right-handed wire) and another similar wire wound left-handed (hereinafter called the left-handed wire). On the other hand, some pieces of chain blocks which can be freely connected to or disconnected from the other end of each of the afore-mentioned right-handed or left-handed wire are mounted on the radioactive ray shielding walls 16 along the vertical direction.

If the two projected portions seem to get in contact with each other while the product 2 is passed upward or downward through the radioactive ray shielding walls 16, select either the right-handed or left-handed wire suitable for rotating the product 2 in a desired direction on the horizontal plane, connect the selected wire to a chain block located at the nearest height, and pull the wire by operating the chain block.

As the wire is pulled, the product 2 begins to rotate itself in the same direction as of the wind direction of the selected wire within the horizontal place.

When the two projected portions are shifted from each other along the rotating direction, stop operating the chain block and stop the rotation of the product, disconnect the selected wire from the chain block, and then continue moving the product upward or downward.

When the product 2 is likely to rotate back to the original position if the selected wire is disconnected from the chain block, do not disconnect the selected wire but operate the chain block so as to loosen the wire according as the upward or downward movement of the product 2, thus preventing the product 2 from rotating back to the original position in moving upward or downward.

In order to rotate the product 2 in an opposite direction, select a different wire and operate in the same manner.

Rotating the product 2 as above can be employed in adjusting the product 2 to the installation position or to the mating piping to be connected to the product 2 to achieve the adjustment quickly, easily and yet with higher precision.

As described above, handling of the product 2 is carried out safely and precisely in a limited space between the radioactive ray shielding walls 16.

Fixed on the radioactive ray shielding walls 16 are some pieces of connecting fittings to which one end of the chain block is freely connected or disconnected. Connected to the other end of the chain block are a freely detachable wire wound horizontally right-handed on the product and another wire wound horizontally left-handed on the product.

According to the embodiments of the present invention, because even under a limited circumstance inside a building where the existing facilities stand closely in the neighborhood of the product 2 to be handled, the product is protected from dangers such as a collision against existing facilities during the product lift-off and precise handling control of the product is possible, the present invention is effective for enhancing the maintainability and working safety of a plant.

In moving the product 2 into a place, which requires the opposite handling to that for the product lift-off, because unbalanced load and impact load can be controlled and precise movement and installation of the product 2 including fine adjustment are possible when adjusting the product 2 carried into a building to the installation position of the product or to the existing piping to be connected to the product, the present invention is effective for enhancing the maintainability and working safety of a plant.

Because controlling the shift between the boom 4 of the large crane 1 and the vertical line above the lifting position of the product 2 quickly is possible, the present invention is effective for improving the accuracy in operating the boom of a large crane.

Besides, because controlling the shift between the boom 4 of the large crane 1 and the vertical line above the lifting position of the product 2 by a three-dimensional method is possible, the present invention is effective for further improving the accuracy in operating the boom of a large crane.

In addition, because in the course of removing the product 2 out of a building or moving into a building under a limited circumstance inside the building where the existing facilities stand closely in the neighborhood of the product 2, swing of the product 2 is eliminated, smooth guidance of the product 2 is achieved by guide rollers 6, and the product is protected from dangers such as a collision against existing facilities, the present invention is effective for further enhancing the safety in removing or moving the product 2 out of or into the building.

According to the present invention, because in handling an equipment inside a building by a crane installed outside, precise handling control of the equipment is possible under a limited circumstance inside a building where the existing facilities stand closely in the neighborhood, the present invention is effective for enhancing the maintainability and working safety of the plant to which the building belongs to.

What is claimed is:

1. Method for handling an equipment inside of a building by a crane installed outside of the building comprising:

lifting up an equipment inside of the building, using a wire hanging from the boom of a crane installed outside of the building;

measuring a shift change at a top of the boom of the crane utilizing a three-dimensional measuring device positioned apart from the crane and the boom thereof;

the three-dimensional measuring device being a light-wave type survey instrument, and reflecting mirrors are mounted at the top of the boom and a position on the boom spaced from the top thereof so as to enable measurement of the shift change by the light-wave type survey instrument; and moving the top of the boom on the basis of a measuring result of the three-dimensional measuring device so as to reduce the shift change when removing said equipment out of said building through an opening provided in the top of said building, by means of derricking said boom upward while the dead load of said equipment is being applied to said wire but said equipment has not yet been fully lifted up, thereby reducing horizontal force applied to said equipment from said wire.

2. Method for handling an equipment inside of a building by a crane installed outside of the building according to claim 1, wherein a controller which controls the position of said equipment is mounted on existing structures near the installation position of said equipment inside said building, and said equipment is lifted up or down along said controller.

3. Method for handling an equipment inside of a building by a crane installed outside of the building comprising:

measuring a shift change at a top of the boom of the crane utilizing a three-dimensional measuring device positioned apart from the crane and the boom thereof;

the three-dimensional measuring device is a light-wave type survey instrument, reflecting mirrors are mounted at the top of the boom and a position on the boom spaced from the top thereof so as to enable measurement of the shift change by the light-wave type survey instrument;

moving the top of the boom on the basis of a measuring result of the three-dimensional measuring device so as to reduce the shift change when carrying an equipment which is lifted up using a wire hanging from the boom of a crane installed outside, into a building through an opening provided in the top of said building; and placing said equipment down at a desired position inside said building by means of derricking said boom downward while the dead load of said equipment still remains on said wire but said equipment is being placed down at said position, thereby reducing horizontal force applied to said equipment from said wire.

4. Method for handling an equipment inside of a building by a crane installed outside of the building according to claim 3, wherein a controller which controls the position of said equipment is mounted on existing structures near the installation position of said equipment inside said building, and said equipment is lifted up or down along said controller.

* * * * *